US005845768A

United States Patent [19]

Simpson

[11] Patent Number: 5,845,768

[45] Date of Patent: Dec. 8, 1998

[54] PACKING FOR RUBBER AND OTHER COMMODITIES

[75] Inventor: Richard Bernard Simpson, Telford, England

[73] Assignees: International Rubber Study Group,, Wembley, England; Common Fund for Commodities,, Amsterdam, Netherlands

[21] Appl. No.: 715,362

[22] Filed: Sep. 11, 1996

[30] Foreign Application Priority Data

Sep. 16, 1995 [GB] United Kingdom ..... 9519007
May 20, 1996 [GB] United Kingdom ..... 9610543

[51] Int. Cl.[6] ..... B65D 19/38; B65D 21/02

[52] U.S. Cl. ..... 206/83.5; 206/386; 108/55.3; 220/4.27

[58] Field of Search ..... 206/83.5, 386, 206/595–600; 108/53.1, 53.3, 55.1, 55.3, 57.1; 220/4.26, 4.27

[56] References Cited

U.S. PATENT DOCUMENTS

| | | | |
|---|---|---|---|
| 3,804,239 | 4/1974 | O'Brien . | |
| 4,000,704 | 1/1977 | Griffin, Jr. . | |
| 4,166,569 | 9/1979 | Begnaud et al. . | |
| 4,516,677 | 5/1985 | Rowland et al. | 108/53.1 |
| 4,619,207 | 10/1986 | Boyce et al. | 108/53.1 |
| 4,667,823 | 5/1987 | Wolfe, Jr., et al. . | |
| 4,735,321 | 4/1988 | Day | 206/597 |
| 4,801,024 | 1/1989 | Flum et al. | 206/597 |
| 4,865,202 | 9/1989 | Day | 206/597 |
| 4,879,956 | 11/1989 | Shuert . | |
| 4,998,619 | 3/1991 | Sowa et al. | 206/386 |
| 5,205,410 | 4/1993 | Kuipers et al. | 206/386 |

FOREIGN PATENT DOCUMENTS

| | | |
|---|---|---|
| 0436783A1 | 7/1991 | European Pat. Off. . |
| 1459919 | 12/1976 | United Kingdom . |
| 2004525 | 4/1979 | United Kingdom . |
| 2180820 | 4/1987 | United Kingdom . |
| 2191174 | 12/1987 | United Kingdom . |
| 2203130 | 10/1988 | United Kingdom . |
| 2216101 | 10/1989 | United Kingdom . |

*Primary Examiner*—Paul T. Sewell
*Assistant Examiner*—Luan K. Bui
*Attorney, Agent, or Firm*—Christie, Parker & Hale, LLP

[57] ABSTRACT

A tray system for use in the packaging of stacked rubber bales, which is adapted to support and stiffen one or more rubber bales when carried thereby such as to control lateral movement of the rubber and to increase the compressive modulus of the stack. The system comprises a plastics base tray for providing a lower support on which bales which has depressions arranged and dimensioned such that the rubber of a bale placed on the base portion can flow into these depressions whereby part of the rubber of the bale effectively acts as a structural part of the tray to provide additional rigidity and strength to the resulting overall package. Intermediate trays are located between adjacent bales in the stack and have surface irregularities for mechanically engaging the rubber bales disposed immediately above and below that tray such as to reduce lateral cold flow of the rubber.

15 Claims, 8 Drawing Sheets

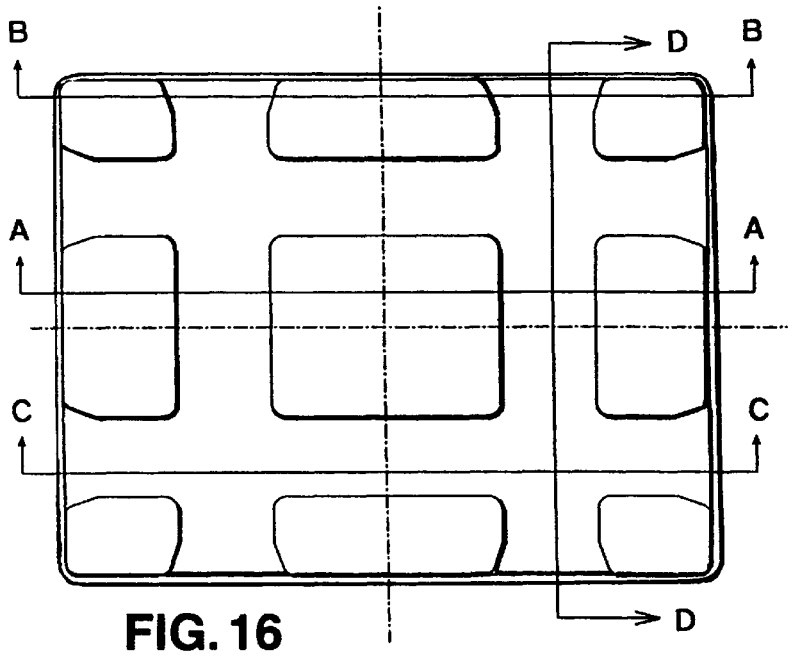
FIG. 16
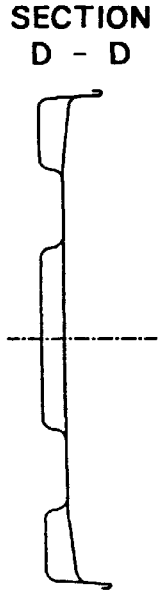
FIG. 17
FIG. 18
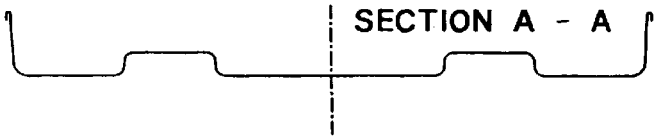
FIG. 19
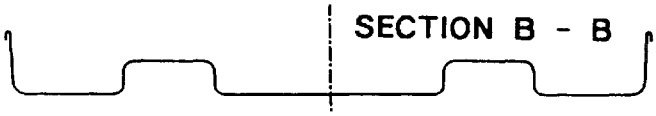
FIG. 20
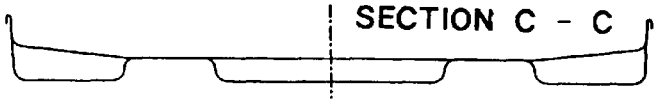
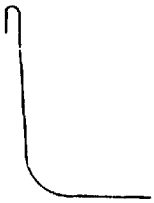
FIG. 21

PACKING FOR RUBBER AND OTHER COMMODITIES

BACKGROUND OF THE INVENTION

The present invention is concerned with the packaging of rubber and other commodities for transportation purposes.

Natural rubber is produced in equatorial Third World countries, packaged into its dry form, in bales, and assembled into lots (usually approximately 1.2 tonne) which are normally protected and packaged in a hardwood crate.

The industry has recognised that such a traditional packaging system has a number of functional and environmental disadvantages.

From a functional point of view, because the packaging is made of hardwood, it can give rise to contamination of the rubber by the wood itself, for example with splinters. Further, the unpackaging operation can also give operator problems in terms of cuts from the nails and strapping that are used within the crate system. The crate is also subject to a certain amount of damage in transit which can lead to problems with handling. From an environmental point of view, the crates being made of hardwood from Third World countries is leading to the destruction of resources which are not readily and rapidly replaceable. Furthermore, at the consumption end of the supply chain, the disposal of the hardwood is causing problems as it is not suitable for subsequent re-use. It is not possible or economically viable to return the crates to their countries of origin.

Consequently, there is a requirement in the industry for a means of packaging natural rubber which gives the necessary functionality whilst at the same time being more environmentally acceptable.

SUMMARY OF THE INVENTION

Thus, an object of the present invention is to provide a low-cost, functional packing system that is re-usable and protects and supports the natural rubber for the duration of its trans-shipment from country of origin to country of consumption.

In accordance with a first aspect of the present invention, there is provided a baled, rubber packaging system, comprising in combination:

- a plastics base tray of a first type providing a lower support on which bales of rubber are stacked;
- at least one intermediate, plastics tray of a second type located between adjacent layers of rubber bales in said stack; and
- a plastics cover tray disposed over the top of such stacked bales;
- the tray of said first type having an integral, substantially rectangular base portion, the whole of the lateral edge of said base portion being extended therefrom to protect bales of rubber on the outside of the stack from external contamination and to laterally constrain the rubber, said base portion having a plurality of depressions arranged and dimensioned such that the rubber of the or each bale disposed on the base portion flows into said depressions whereby at least part of the rubber of that bale or bales effectively acts as a structural part of the tray to provide additional rigidity and strength to the overall package, and said base portion defining external recesses which provide locations for strapping and for fork lift access; and
- the tray of said second type having surface irregularities which mechanically engage the rubber bales disposed immediately above and below that tray such as to reduce lateral cold flow of the rubber.

In accordance with a second aspect of the present invention, there is provided a plastics tray system for packaging rubber bales, comprising in combination:

- a plastics base tray of a first type for providing a lower support on which bales of rubber can be stacked;
- one or more plastics intermediate trays of a second type for location between adjacent layers of rubber bales in said stack;
- and a plastics cover tray for disposal over the top of such stacked bales;
- the tray of said first type having an integral, substantially rectangular base portion the whole of the lateral edge of said base portion being extended therefrom for protecting bales of rubber on the outside of the stack from external contamination and for laterally constraining the rubber, said base portion having a plurality of depressions arranged and dimensioned such that the rubber of a bale placed on the base portion can flow into said depressions whereby at least part of the rubber of the bale effectively acts as a structural part of the tray to provide additional rigidity and strength to the resulting overall package, and said base portion defining external recesses which provide locations for strapping and for fork lift access; and
- the tray of said second type having surface irregularities for mechanically engaging the rubber bales disposed immediately above and below that tray such as to reduce lateral cold flow of the rubber.

In use, a tray of the second type is placed between every layer, or every other layer, of the bales of rubber in order to stiffen the rubber by increasing its "shape factor", i.e. the interleaving of a relatively stiff material provided by the tray prevents the rubber moving laterally and increases the compressive modulus of the stack, whereby lateral elastic deformation or creep/cold flow (creep being proportional to the elastic deformation) does not deform the rubber and the stacking loads are resisted.

In some embodiments, the tray of second type has a substantially flat base whose lateral edge is extended upwardly for laterally constraining the rubber and for protecting the bales of rubber on the outside of the package from contamination.

The lateral edge of the tray of second type is also preferably extended downwardly beyond the level of the base to enable a tray to locate on the layer of rubber below.

The extent of downward extension of the lateral edge of the tray is preferably substantially the same as the maximum height of said lateral edge of the tray above said base.

Advantageously, the base region of the tray of second type has a textured finish in order to grip the rubber in contact with it, above and below, such that the shape factor advantage is fully exploited.

The depth of projection of the lateral edges of the tray upwards and downwards is preferably such that the rubber is fully covered along its edges.

Advantageously, the lateral edges of all trays are formed with a draft angle so that, when not loaded with rubber bales, they can nest for compact storage or return to the country of use.

In a preferred embodiment the base of the tray of first type is provided with a plurality of rectangular depressions arranged such that the remaining floor area of the tray provided by the base is a lattice or matrix of mutually perpendicular sections.

Advantageously, the combined area of said rectangular depressions constitutes a significant proportion, preferably greater than 35% and still more preferably greater than 45%, of the total base area of the tray whereby a corresponding proportion of the load on that tray acts directly onto the ground.

Advantageously, the base of the tray of first type is essentially flat but is inclined gently upwardly at its edge regions which merge with said upstanding lateral edge of the tray.

Because, inter alia, the tray of first type has said external recesses in its base for directly receiving the forks of a conventional fork lift, there is no need for this tray to be mounted on a conventional wooden pallet and a "palletless" arrangement is thereby achieved.

BRIEF DESCRIPTION OF THE DRAWINGS

The invention is described further hereinafter, by way of example only, with reference to the accompanying drawings, in which:

FIG. 16 is a plan view from below of a slightly modified version of the palletless tray of first type of FIGS. 11–15;

FIGS. 17, 18, 19 and 20 are sections on the line D—D, A—A, B—B and C—C of FIG. 16, respectively;

FIG. 21 is an enlarged detail view of an edge region of the tray of FIG. 16;

DESCRIPTION OF THE PREFERRED EMBODIMENTS

Figure 1:
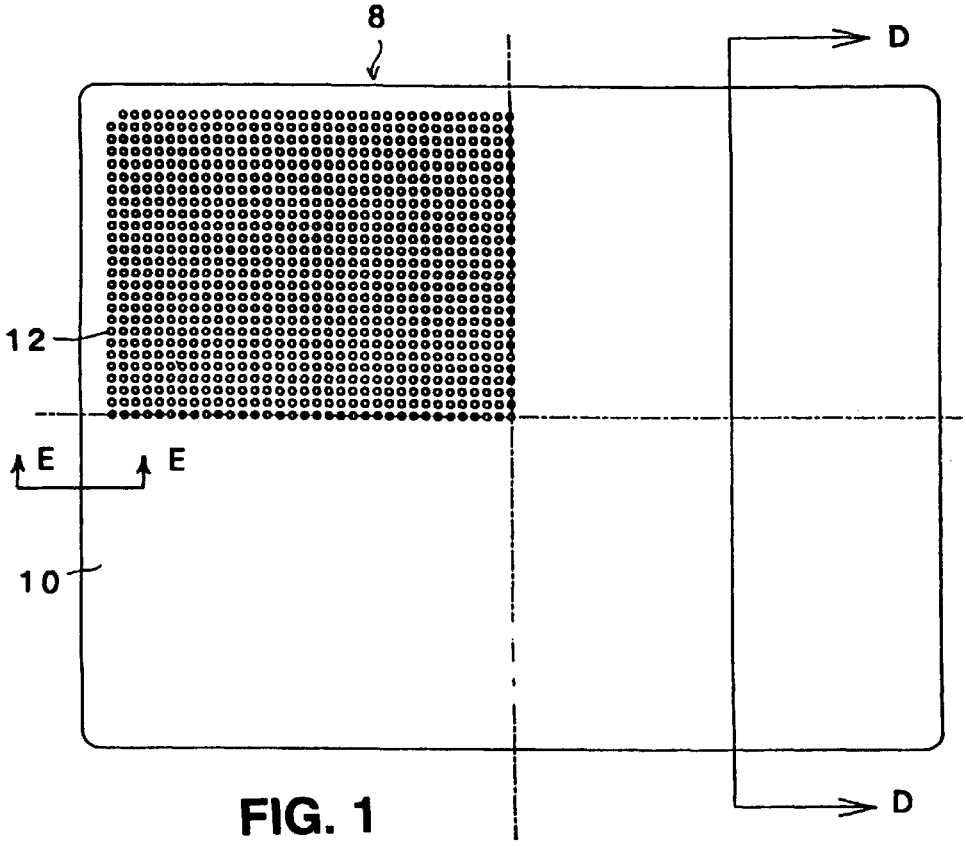
FIG. 1 is a plan view from above and one end of one embodiment of a packaging tray of second type in accordance with the present invention.
Figure 2:
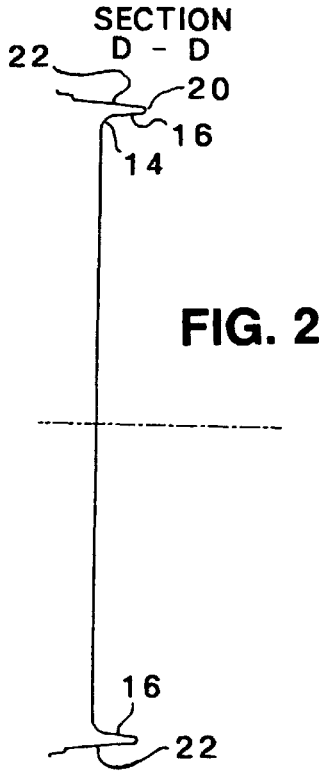
FIG. 2 is a section on the line D—D in FIG. 1.
Figure 3:
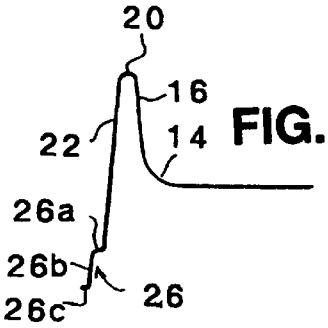
FIG. 3 shows a detail of the section of FIG. 2 to a larger-scale.
Figure 4:
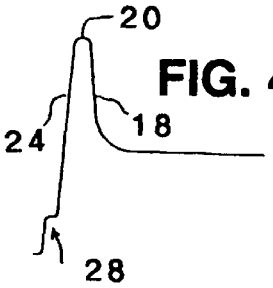
FIG. 4 is a section of the line E—E in FIG. 1 to the same enlarged scale as FIG. 3.

Referring first to FIGS. 1 and 2, the first embodiment of packaging tray 8 for use with this invention comprises a generally planar, rectangular base 10 having a plurality of holes, depressions or protrusions 12 for the purpose of better gripping bales of natural rubber placed thereon (and therebeneath). Rising upwardly from the base 10, and coupled to the base by a smoothly convex rolled portion 14, are inner side and end walls 16,18. As best seen in FIGS. 3 and 4, the inner side and end walls 16, 18 have a small outward inclination or "draw" (usually about 3°) towards their upper ends and are rolled over at 20 to define their upper extremities, before extending downwardly again, with a further outward inclination towards their lower ends, to define outer side and end walls 22,24, which extend downwardly beyond the underside surface of the base 10, preferably by a distance substantially equal to the height of the top of the side and end walls 16, 18 above the base 10. The lowermost ends of the depending side and end walls 22,24 have a doubled kink 26,28 of generally flattened "S" shape, as best seen in FIGS. 3 and 4. In this embodiment, the kink 26 comprises a outwardly extending portion 26*a*, a downwardly extending portion 26*b* parallel to the main wall portion 22 and a further outwardly extending portion 26*c*. The kink in the end wall 24 is shaped similarly. The rolled convex portions 14 and 20 and the kinked portions 26 and 28 all serve to increase the strength and rigidity of the tray.

The height of the inner side walls 16,18 is selected to suit the particular size of the rubber bales 30 with which the tray is to be used. Thus, this height may, for example, be roughly equal to the bale height so that the top surface of a bale lies flush with the top edge 20 of the side and end walls, or, in another example, the height may be less than the bale height so that an upper portion of the bale extends above the top edge 20 of the tray. In all cases, however, the outer side walls 22,24 are dimensioned so as to descend well beyond the level of the base 10 sufficiently to protect and laterally locate a bale 30 in a lower level when the trays/bales are stacked, as described hereinafter.

Figure 5:
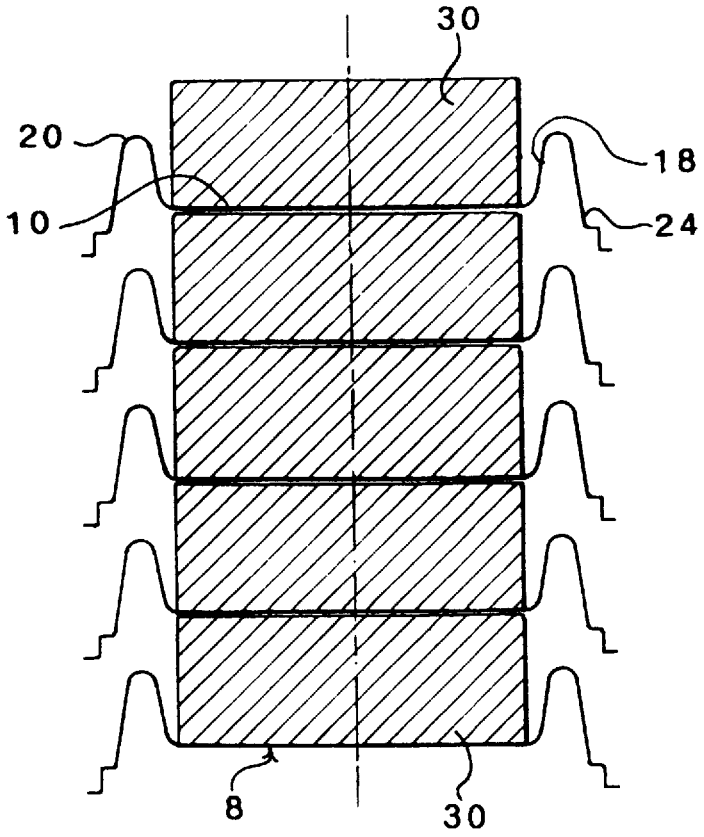
FIG. 5 is a diagrammatic sectional end view showing the embodiment of FIGS. 1 and 2 in use in a stacking mode.
Figure 6:
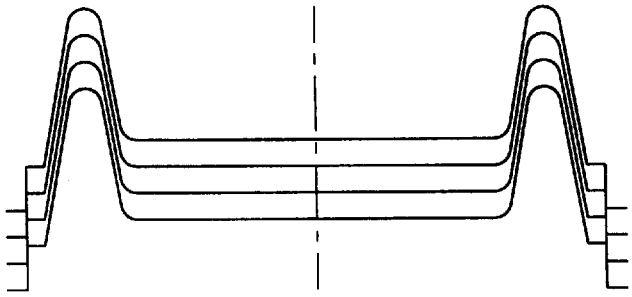
FIG. 6 is a diagrammatic sectional end view, corresponding to FIG. 3 but in a nesting mode with no rubber bales present.
Figure 7:
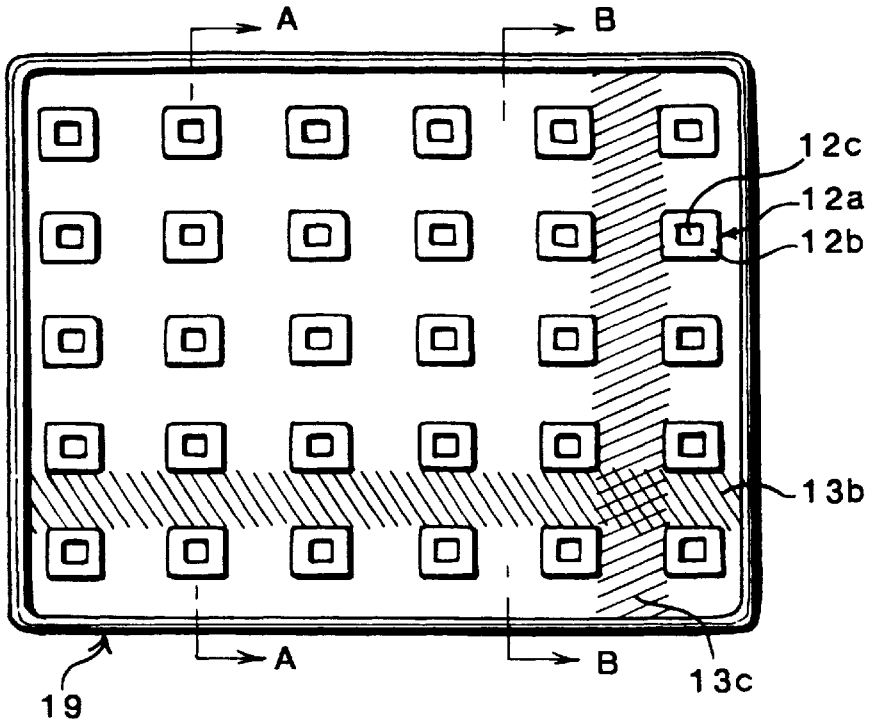
FIG. 7 is a plan view of a second embodiment of a packaging tray of second type in accordance with the invention.
Figure 8:
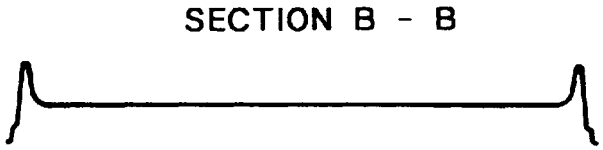
FIGS. 8 and 9 are sections on the lines B—B and A—A in FIG. 7, respectively.
Figure 9:
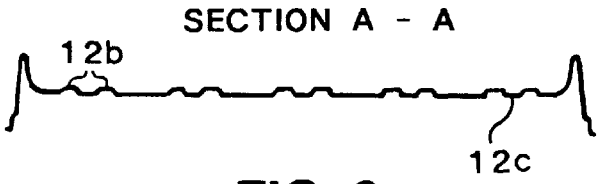
Figure 10:
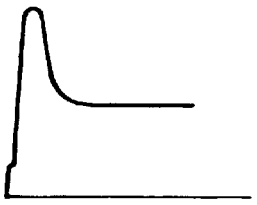
FIG. 10 is an enlarged detail view of an edge region of the tray of FIG. 7.
Figure 11:
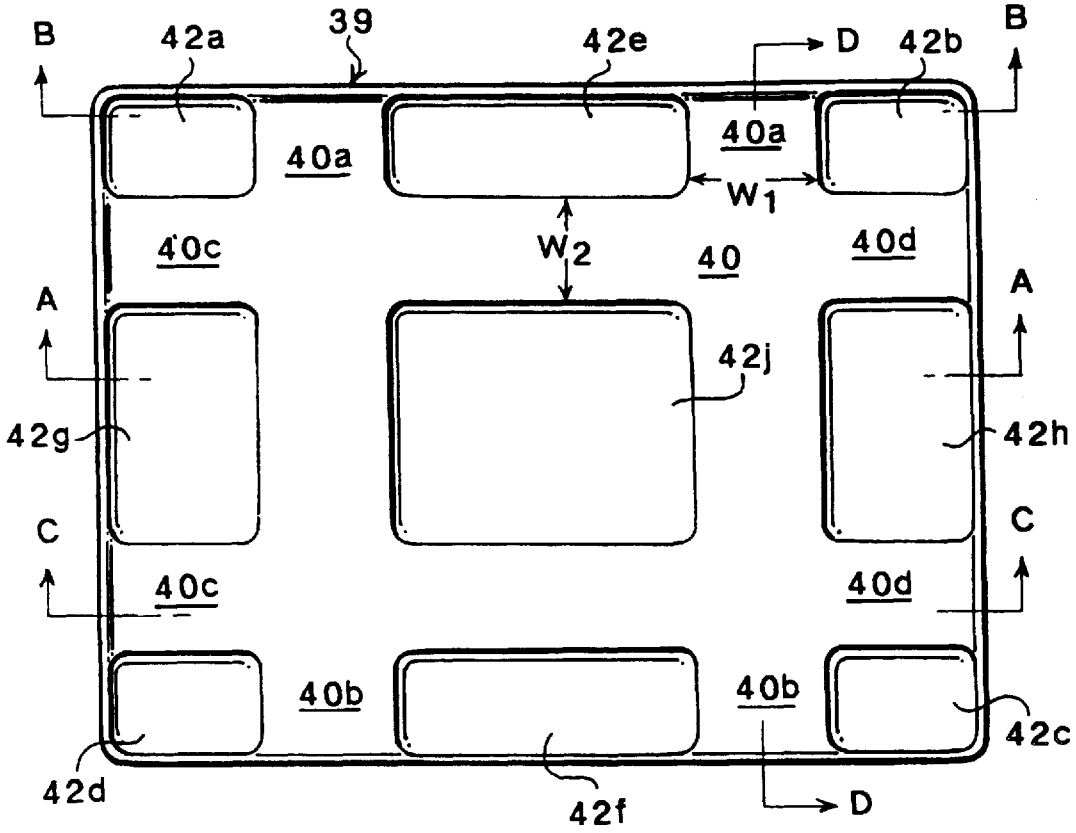
FIG. 11 is a plan view from above of an embodiment of a palletless tray of first type in accordance with the present invention.

FIG. 5 illustrates a stack of five identical tray/bale sets in the case where each tray 8 carries a plurality of bales 30 whose combined length and width dimensions correspond substantially to the length and width of the tray base 10 and whose height is substantially equal to that of the side and end walls 16,18 of the tray. It will be noted that, as a result of the "draw" on the inner side and end walls 16,18 of the trays, when in the stacked condition, the base of an upper tray does not engage the side or end walls of the tray below but rests rather on the top surface of the rubber bale 30 carried by that lower tray. Furthermore, the combined effect of the "draws" on the inner and outer side and end walls enables the trays to "nest" fully as shown in FIG. 6, when no bales are present in the trays. It will also be noted from FIG. 5 that the lower ends of the outer side and end walls 22,24 engage over the upper edges of the tray beneath so that when a stack is fully assembled (usually five or six high), the whole assembly is laterally stable. Lateral deformation of the bales under stacking loads or creep of the bales due to cold flow is resisted by the engagement of the bale with the upstanding inner side and end walls 16, 18 of the associated tray.

In addition, because the present structure makes it possible to interleave relatively thin bales with trays, lateral motion and deformation of the rubber is also resisted by contact of the upper and lower surfaces of each bale with the textured horizontal faces of the trays above and below.

A preferred material for the tray 8 of FIGS. 1 to 6 is an olefinic polymer having a thickness of about 3 mm.

Referring now to FIGS. 7 to 10, there is shown a second embodiment of a packaging tray 19 for use with the present invention. The basic shape and configuration of this tray are the same as that of the embodiment of FIGS. 1 to 6 and the same reference numerals have been applied to identical parts. The principal difference is that the plurality of small holes/depression/protrusions 12 of the first embodiment which provide the texturing for the tray surface have been replaced by an array consisting of a smaller number of much larger depression/protrusion elements 12*a*. In this embodiment, each such element 12*a* consists of a raised rectangular land portion 12*b* surrounding a central unraised portion 12*c*. In other embodiments, the converse (female) configuration could be used in which the land portion 12*b* is formed as a rectangular depression surrounding the central portion 12*c*. These shapes are merely given as examples and the elements 12*a* could equally take other configurations, provided that depressions and/or protrusions exist on both the upper and lower sides of the tray. However, in all cases, it is advantageous that the presence of the texturing features 12*a* does not have the effect of detracting significantly from the lateral stiffness of the overall tray. This can be achieved by leaving large areas of the tray as continuous flat material, unbroken by any protrusions/depressions. It will be noted from FIG. 7 in this connection that the present tray comprises an array of orthogonal strip-like regions of flat material between the texturing features 12*a*, two such regions 13*a* and 13*b* being indicated by cross-hatching in FIG. 7.

Referring now to FIGS. 11 to 15, there is shown a further embodiment of tray 39 for use with the present invention which enables the necessity for a conventional wooden pallet to be removed altogether.

Figure 12:
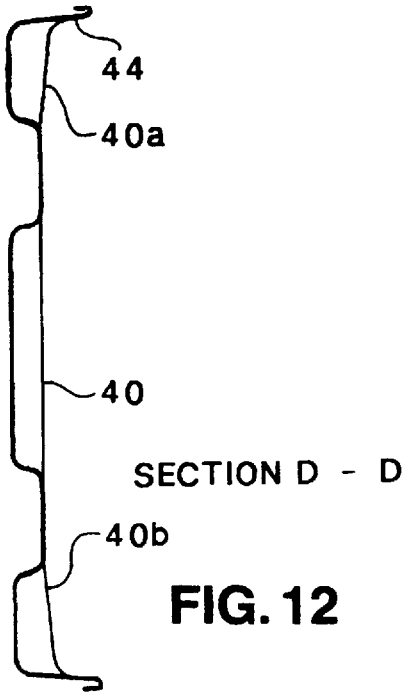
FIGS. 12, 13, 14 and 15 are sectional views on the lines D—D, C—C, B—B and A—A in FIG. 11, respectively.
Figure 13:
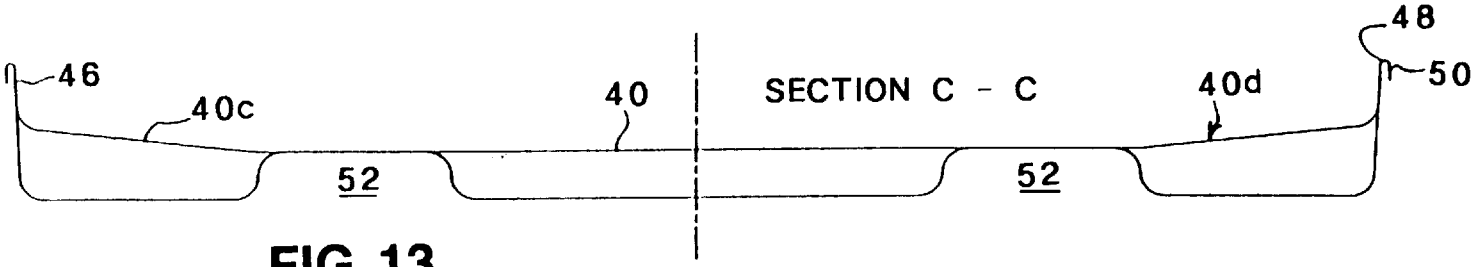
Figure 14:
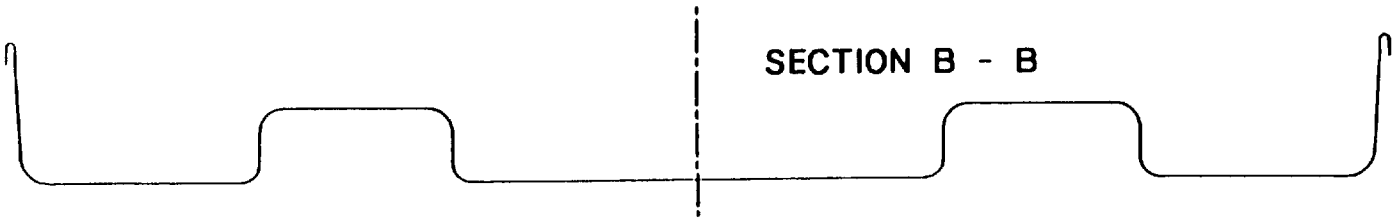
Figure 15:
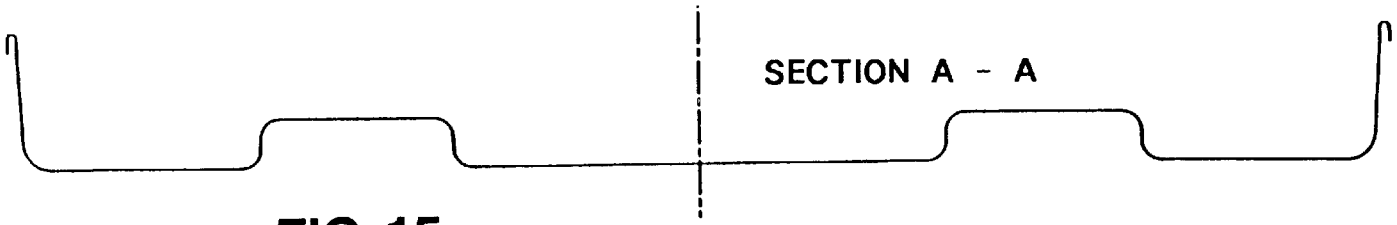

The tray 39 of FIGS. 11 to 15 comprises a substantially rectangular base portion 40 which is generally flat in its central section but which rises generally upwards towards its periphery as indicated at 40*a* and 40*b* in FIG. 12 and at 40*c* and 40*d* in FIG. 13. Formed within the base portion 40 are a plurality of rectangularly sectioned depressions 42 consisting of four equally sized corner depressions 42*a*,42*b*, 42*c*,42*d*, two equally sized side depressions 42*e*,42*f*, two equally sized end depressions 42*g*,42*h* and one relatively large central depression 42*j*. Thus, the floor area of the base 40 which remains to provide a seat for a bale consists of a perpendicular lattice or matrix of cross strips of roughly width $W_1$ and $W_2$.

As best seen in FIGS. 12 and 13, the base 40 merges smoothly with upstanding side and end walls 44,46 which have a small outward "draw" of about 3°–5° and are rolled over at the top at 48, before extending downwardly at 50.

A palletless tray 39 of the type shown in FIGS. 11 to 15 is used at the bottom of a stack, and sometimes also at the top, with the intermediate layers of bales being supported by one or more trays of the type shown in FIGS. 1 to 6 or FIGS. 7 to 10. When bales of rubber are placed onto the latticed base portion 40 of the tray of FIGS. 11 to 15, the rubber cold flows into the plurality of depressions 42 so as eventually to substantially fill these depressions with rubber. The rubber extending into the depressions, while remaining an integral part of the mass of rubber constituting the bale, serves to substantially increase the rigidity of the tray and the rigidity and strength of the overall package since the rubber effectively acts as an integral part of the tray. The increase in rigidity obtained by this structure is such that there is no need for a conventional supporting pallet at all since the function of the conventional pallet is provided by the combination of the rubber and the new tray. In other words, the rubber itself is used as a structural medium for adding rigidity to an otherwise relatively weak tray.

A similar effect is obtained by cold flow of rubber into the textured features of the intermediately located trays, eg. into the depressions and/or around the protrusions (12*a*) of the trays of FIGS. 7 to 10.

Stacking of trays one on another is thereby possible in a similar manner to the first embodiment whereby a thin and flexible plastics material can support a stack of bales at least six to seven bales high, whilst maintaining the rigidity and resilience of the overall package.

Figure 22:
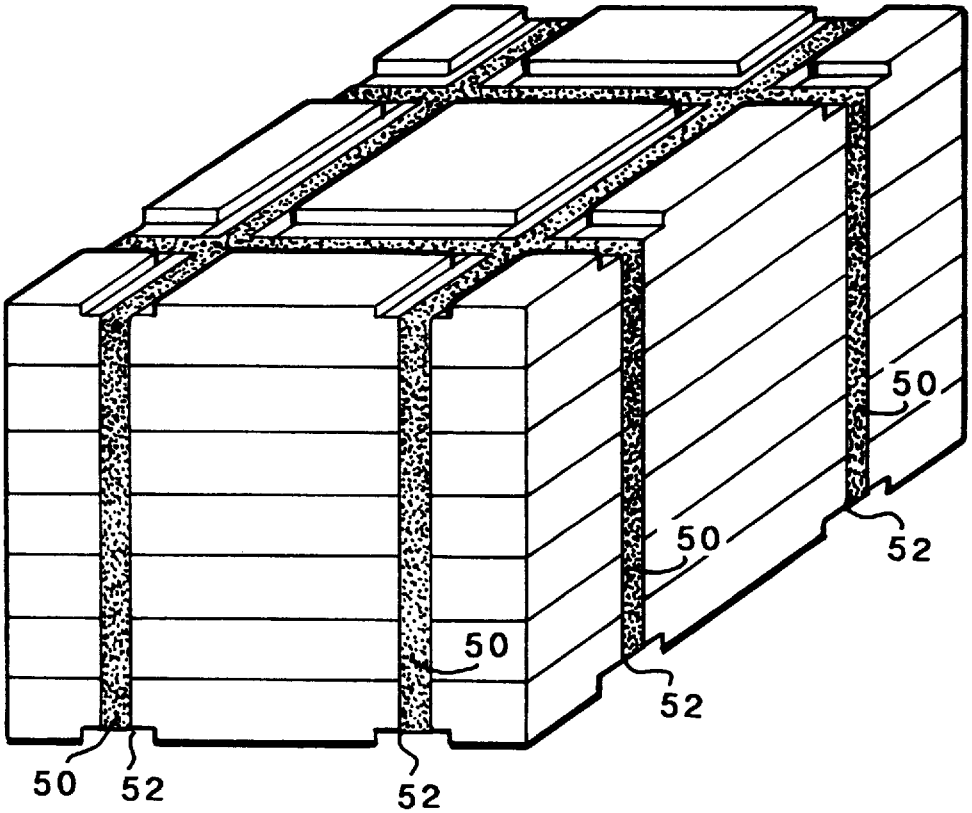
FIG. 22 is a perspective view of a fully packaged set of bales ready for shipment/transportation.

As shown in FIG. 22, in a typical practical example, a "palletless" tray 39 of the type shown in FIGS. 11 to 15 is disposed at the base of the stack of bales and another such tray 39 is disposed, in an inverted orientation at the top. Individual intermediate layers of bales are supported on trays 8 of the type shown in FIGS. 1 to 6 or, preferably, the type 19 of FIGS. 7 to 10. Each tray normally supports a plurality of relatively smaller bales making up a horizontal layer of such bales, but in some cases there could be just a single (larger) bale per tray. Straps 50 can be located in the internal recesses 52 defined by the internal depressions 42 so as to be protected against damage in transit. The latter external recesses 52 (see also FIG. 13) also provide access for the forks of a fork-lift at all sides and ends of the package.

Figure 23:
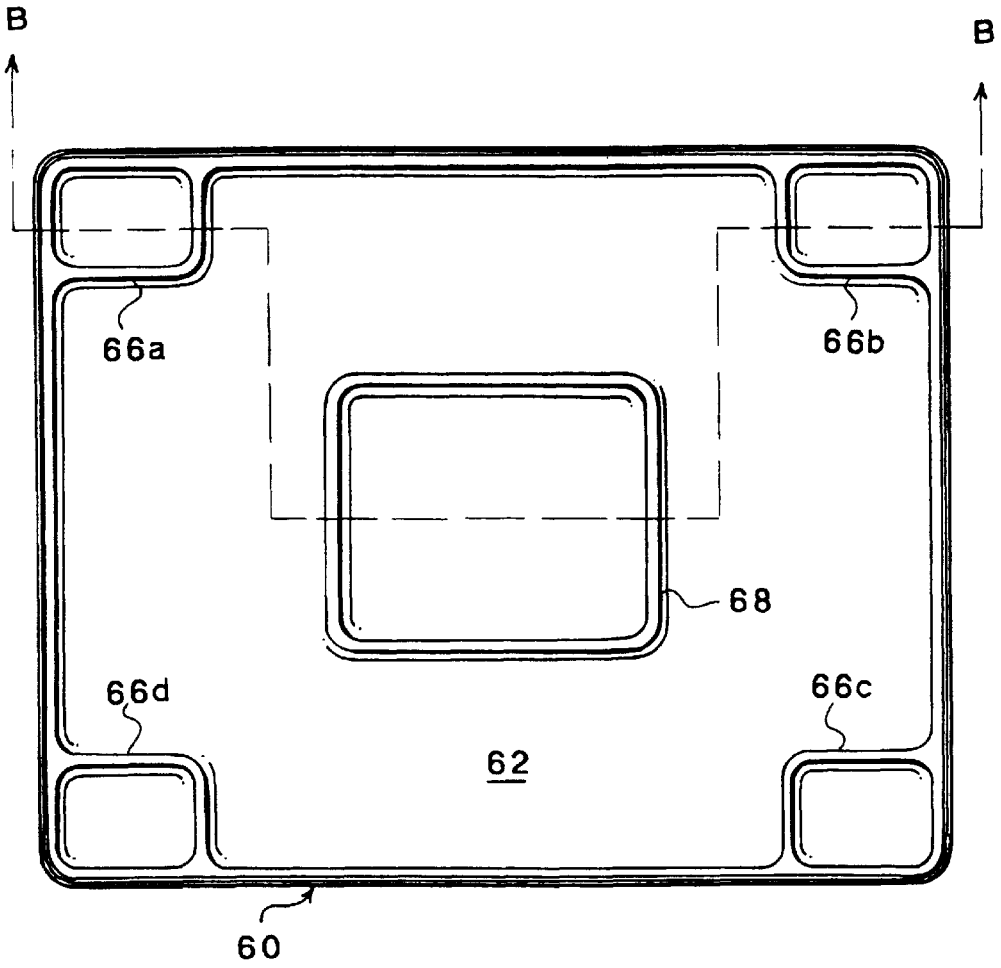
FIG. 23 is a plan view of an embodiment of a cover tray.
Figure 24:
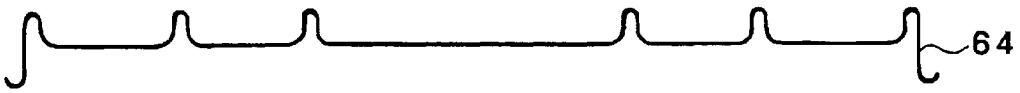
FIG. 24 is a section on the line B—B in FIG. 23.

In other embodiments, a special cover tray may be used at the top of the stack, rather than using an inverted "palletless tray" of the type used at the bottom of the stack. An example of one such cover tray is shown in FIGS. 23 and 24. This tray 60 has a generally planar base 62 with a peripheral wall 64 which rises upwardly via a convex rolled portion to an upper extremity and then extends downwardly, with a further upward turn at the lowermost end. Each corner of the tray 60 is formed with an upwardly extending rectangular wall 66*a*, 66*b*, 66*c*, 66*d*. There is also an upwardly extending central rectangular wall 68. In use, these five upwardly extending rectangular walls 66,68 are available to matingly engage over the projecting underside parts forming the depressions 42(*a* to *g*) of a further palletless tray of the type shown in FIGS. 11 to 15 or 16 to 21 at the bottom of another baled package which is to be located on top of the first package. This mating engagement thereby provides positive location of the second package on the first for assisting stability of the overall stacked arrangement. The plain areas between the upstanding walls 66,68 provide spaces for receiving strapping.

FIGS. 16 to 21 show a slightly modified version of the palletless tray of FIGS. 11 to 15 wherein the sides of the depressions 42(*a*–*h*) are profiled such as to provide a tapered entrance to the grooves formed by these depressions which received the forks of the fork lift and thereby facilitate entrance of such forks under the tray assembly without damage to the tray.

In all cases, the upper ends of the depressions 42 in the palletless trays of the types shown in FIGS. 11 to 15 and 16 to 21 are preferably of smoothly rounded profile so as to facilitate removal of the rubber from these depressions when the package is eventually to be disassembled.

The top and bottom "palletless" trays of the type shown in FIGS. 11 to 15, together with the one or more intermediate packaging trays of the type shown in FIGS. 1 to 6 or FIGS. 7 to 10, thereby constitute a packaging system having a number of associated advantages and factors as follows.

Because the trays are made entirely of plastics material, the present use of wood/nails is entirely eliminated thereby reducing contamination and injury risks. The trays are inherently robust, the low modulus polymer which is preferably used offering resistance to mis-handling.

The components are re-usable and the materials re-cyclable.

The interlocking function of adjacent trays gives lateral support and stability during handling and transport.

Cold flow between vertical layers is reduced due to the stiff interlayer relative to the rubber.

The overlapping side/end edges of the trays protect the rubber bales and reduce the risk of contamination thereto.

The resulting packages are compatible with current work practices, the dimensions and general manoeuvrability being compatible with standard pallets. The packages are suitable for containerisation.

The trays nest together for return to the product source and re-use, thereby reducing volume for return of components.

The textured base of the trays (the base 40 of the tray of FIGS. 11 to 15 or 16 to 21 can be textured in a similar manner to that described for the tray of FIGS. 1 to 6) allows mechanical keying of the rubber to the tray.

The area of the lowermost tray which is in contact with the ground for load transference purposes (i.e. the combined area of the bases of the depressions 42 in the embodiment of FIGS. 11 to 15) is a relatively large proportion of the total base area of the tray (more than 45% in this example) so that a high proportion of the load pacts directly on the ground, so reducing the load proportion supported by the tray.

The palletless tray may be treated on its outer surface to raise the coefficient of friction when in contact with another palletless tray so as to assist in stabilizing the stack. The treatment may be by a texture or by a rubbery type of coating which has an intrinsically high coefficient of friction.

The fork access features on the palletless tray facilitate: (a) strapping in that the straps 50 do not get damaged and cannot slip off, (b) handling of the package with conventional slings, (c) easy fork access to multiple stacks in that the space for fork access is doubled in height; the stabilization of stacks by the introduction of rigid locking bars (not illustrated) into the double-height gap.

The flow of rubber into all the configurational details of the inside surface of the palletless tray reinforces the material of the tray to prevent impact damage.

The trays of FIGS. 1 to 6 and 7 to 10 should preferably be formed from a tough material that has no tendency to shatter and that can withstand large deformations without significant damage thereto, ie. no shattering, breaking or permanent deformation.

The trays are suitable for vacuum forming, thereby having the potential for low manufacturing costs, or for injection moulding for high volume.

Use of olefine polymers offers low material costs and preferred material properties.

The wasted space occupied by conventional pallets is saved, giving the potential for larger packages and hence reduction of unit shipping costs.

Whereas the above description has referred to the packaging of natural rubber, the trays could of course equally well be used for the transportation of synthetic rubber and indeed of other commodities such as sugar and other bagged minerals and particulate materials.

Advantageously trays are vacuum formed using a thermoplastic with a modulus of the order of 1–2 GPa whereby it can give the restraint necessary for the desired improvement in shape factor.

The stacked bales/trays can, if desired, be shrink-wrapped for extra protection during transportation.

It is claimed:

1. A baled, rubber packaging system, comprising in combination:

a plurality of bales of rubber of cuboidal configuration arranged in a stack, each of said bales having a top and a bottom surface and four side surfaces;

a plastics base tray of a first type providing a lower support on which a bottom one of said plurality of bales of rubber is stacked;

at least one plastics intermediate tray of a second type located between adjacent layers of rubber bales in said stack;

and a plastics cover tray disposed on a top one of such stacked bales;

said base tray of said first type having an integral, substantially rectangular base portion, the whole of the lateral edge of said base portion being extended therefrom to protect said plurality of bales of rubber on the outside of the stack from external contamination and for laterally constraining the rubber, said base portion having a plurality of depressions, each having a smoothly rounded profile, and arranged in orthogonal rows whereby the remaining floor area of the tray provided by the base is a matrix of mutually perpendicular, substantially planar sections, whereby some rubber of each of said bales adjacent the base portion is received in said depressions by cold flow whereby at least part of the rubber of the bale effectively acts as a structural part of the tray to provide additional rigidity and strength to the resulting overall package, and said base portion defining external recesses which provide locations for strapping and for fork lift access; and the tray of said second type having projections and recesses which mechanically engage the rubber bales disposed immediately above and below that tray to reduce lateral cold flow of the rubber.

2. A packaging system according to claim 1, wherein said trays of said second type have a substantially flat base portion whose lateral edge is extended upwardly for protecting the bales of rubber on the outside of the package from contamination and for laterally constraining the rubber.

3. A packaging system according to claim 2, wherein said lateral edge of each tray of said second type is also extended downwardly beyond the plane of the substantially flat base to enable the tray to locate on the layer of rubber below.

4. A packaging system according to claim 3, wherein the extent of downward extension of the lateral edge of the tray of the second type is substantially the same as the maximum height of said lateral edge of the tray above said base portion.

5. A packaging system according to claim 3, wherein the depth of projection of the lateral edges of the tray upwards and downwards is such that the rubber is fully covered along its edges.

6. A packaging system according to claim 1, wherein the projections and recesses on said base portion of the tray of second type comprise a plurality of raised portions which project from one side surface of the base portion and form corresponding recesses on the opposite side surface.

7. A packaging system according to claim 6, wherein said raised portions are disposed in orthogonal rows and columns so as to leave a plurality of similarly mutually orthogonal regions extending across the whole width and along the whole length of the rectangular base portion which are flat and devoid of said raised portions.

8. A packaging system according to claim 1, wherein the cover tray comprises four raised corner portions and a raised central portion, the raised corner and central portions defining location devices for engaging with mating components on the underside of a base tray of the first type of another similar tray system disposed thereover and also defining strapping locations therebetween.

9. A packaging system according to claim 1, wherein the lateral edges of all trays are formed with a draft angle so that, when not loaded with rubber bales, they can nest for compact storage.

10. A packaging system according to claim 1, wherein said base of the tray of first type is provided with a plurality of rectangular depressions arranged such that the remaining floor area of the tray provided by the base is a matrix of mutually perpendicular sections.

11. A packaging system according to claim 10, wherein the combined area of said rectangular depressions constitutes a significant proportion of the total base area of the tray whereby a corresponding proportion of the load on that tray acts directly onto the ground.

12. A packaging system according to claim 1, wherein the base of the tray of first type is essentially flat but is inclined gently upwardly at its edge regions which merge with said upstanding lateral edge of the tray.

13. A packaging system according to claim 1, wherein said trays of said second type have a substantially flat base portion having a lateral edge which is extended upwardly from said base portion and also projected below the base portion, the height and depth of projection of said lateral edge of the tray upwards and downwards being dimensioned so that said side surfaces of the bales on the outside of said stack are fully covered by said lateral edges of the trays of said second type.

14. A packaging system according to claim 1, wherein the substantially planar sections define external recesses which provide locations for strapping and for fork lift access are.

15. A plastics tray system for packaging a plurality of rubber bales of cuboidal configuration, each having top and bottom surfaces and four side surfaces comprising:

a plastics base tray of a first type for providing a lower support for stacking such rubber bales;

at least one intermediate, plastics tray of a second type for positioning between adjacent layers of such rubber bales in said stack; and a plastics cover tray for disposal over the top of such stacked bales;

said base tray of said first type having an integral, substantially rectangular base portion, the whole of the lateral edge of said base portion being extended therefrom to protect bales of rubber on the outside of the stack from external contamination and to laterally constrain the rubber, said base portion having a plurality of depressions, each having a smoothly rounded profile, and arranged in orthogonal rows whereby the remaining floor area of the tray provided by the base is a matrix of mutually perpendicular, substantially planar sections, whereby some rubber of each of said bales adjacent the base portion is received in said depressions by cold flow whereby at least part of the rubber of that bale effectively acts as a structural part of the tray to provide additional rigidity and strength to the overall package, and said base portion defining external recesses which provide locations for strapping and for fork lift access; and the tray of said second type having projections and recesses for mechanically engage the rubber bales disposed immediately above and below that tray to reduce lateral cold flow of the rubber, wherein said trays of said second type have a substantially flat base portion having a lateral edge which is extended upwardly from said base portion and also projected below the base portion, the height and depth of projection of said lateral edge of the tray upwards and downwards being dimensioned so that said side surfaces of the bales on the outside of said stack are fully covered by said lateral edges of the trays of said second type.

* * * * *